US006217314B1

(12) United States Patent
Kiesinger et al.

(10) Patent No.: US 6,217,314 B1
(45) Date of Patent: Apr. 17, 2001

(54) DISPOSABLE, RECYCLABLE OIL CANDLE

(75) Inventors: Frederick C. Kiesinger, Mexico; J. Alan Menter, Manlius, both of NY (US)

(73) Assignee: Muench-Kreuzer Candle Company, Syracuse, NY (US)

( * ) Notice: Subject to any disclaimer, the term of this patent is extended or adjusted under 35 U.S.C. 154(b) by 0 days.

(21) Appl. No.: 09/567,925

(22) Filed: May 10, 2000

Related U.S. Application Data

(60) Provisional application No. 60/133,780, filed on May 12, 1999.

(51) Int. Cl.[7] ..... F23D 3/24
(52) U.S. Cl. ..... 431/320; 431/125
(58) Field of Search ..... 431/320, 322, 431/324, 125, 297, 295, 296

(56) References Cited

U.S. PATENT DOCUMENTS

| | | | | |
|---|---|---|---|---|
| 227,660 | * | 5/1880 | Spear | 431/297 |
| D. 325,642 | | 4/1992 | Hollingsworth | D26/8 |
| D. 358,222 | | 5/1995 | Kane | D26/23 |
| 813,940 | | 2/1906 | Bentote . | |
| 1,360,387 | * | 11/1920 | Fisher | 431/320 |
| 1,583,798 | * | 5/1926 | Rosenberg | 431/320 |
| 1,647,898 | * | 11/1927 | Bearse | 431/297 |
| 2,057,943 | * | 10/1936 | Friedrichs | 431/297 |
| 2,111,642 | * | 3/1938 | Saier | 431/297 |
| 2,503,496 | * | 4/1950 | Kwasniewski | 431/320 |
| 2,512,885 | * | 6/1950 | Archambeau | 431/320 |
| 2,515,924 | * | 7/1950 | Hunicke | 431/320 |
| 2,709,907 | * | 6/1955 | Robertson et al. | 431/297 |
| 2,749,733 | | 6/1956 | Smith et al. | 67/87 |
| 2,750,775 | * | 6/1956 | Robertson et al. | 431/297 |
| 3,036,452 | * | 5/1962 | Renwick et al. | 431/320 |
| 3,081,612 | * | 3/1963 | Roscovich | 431/320 |
| 3,169,387 | * | 2/1965 | Cordillo | 431/320 |
| 3,174,311 | * | 3/1965 | Arbetman | 431/320 |
| 3,308,638 | * | 3/1967 | Binderman | 431/320 |
| 3,315,497 | * | 4/1967 | MacDonald | 431/320 |
| 3,360,966 | * | 1/1968 | Binderman | 431/320 |
| 3,697,739 | | 10/1972 | Novak et al. | 240/17 |
| 3,918,888 | * | 11/1975 | Clarke et al. | 431/297 |
| 3,994,672 | | 11/1976 | Novak | 431/320 |
| 4,240,974 | * | 12/1980 | Little et al. | 558/46 |
| 4,261,695 | | 4/1981 | Reninger | 431/320 |
| 4,567,548 | | 1/1986 | Schneeberger | 362/161 |
| 4,608,011 | | 8/1986 | Comstock | 431/324 |
| 4,693,681 | | 9/1987 | Comstock | 431/324 |
| 5,057,003 | | 10/1991 | Yang | 431/125 |
| 5,089,209 | * | 2/1992 | Bailey et al. | 264/540 |

(List continued on next page.)

*Primary Examiner*—Ira S. Lazarus
*Assistant Examiner*—David Lee
(74) *Attorney, Agent, or Firm*—Eugene Stephens & Associates

(57) ABSTRACT

A fully disposable oil candle comprises a disposable blow-molded exterior resin shell made to resemble a conventional beeswax candle and an inner disposable fuel cell. By configuring the fuel cell to include a separating structure to fit within a radial groove inside the opening of the shell, the cell and the exterior shell can be permanently joined, forming a candle that closely resembles an ordinary beeswax candle. Moreover, the separating structure of the fuel cell acts to provide distance between the fuel cell and the exterior shell, partially insulating the exterior shell from the heat of the fuel cell. By maintaining an insulating distance between the fuel cell and the exterior shell, the exterior shell can be made less robust. The result is a candle that is less expensive to manufacture and ship and more convenient for consumers to use. In addition, the separating structure can act as a safety feature by making it more difficult for individuals to remove the fuel cell from the candle once assembled. Finally, our candle includes a uniquely shaped base to enable it to fit most standard-sized candle holders, making our candle more versatile than other oil candles on the market.

37 Claims, 4 Drawing Sheets

U.S. PATENT DOCUMENTS 5,320,521 * 6/1994 Bussu ..... 431/320
5,442,036 * 8/1995 Beavers et al. ..... 528/296
5,523,382 * 6/1996 Beavers et al. ..... 528/296
5,547,371 * 8/1996 Rose ..... 431/320

* cited by examiner

DISPOSABLE, RECYCLABLE OIL CANDLE

This application claims the benefit of U.S. Provisional Application No. 60/133,780, filed on May 12, 1999, which provisional application is incorporated by reference herein.

TECHNICAL FIELD

Design and manufacture of oil candles.

BACKGROUND OF THE INVENTION

Oil candles are commonly used for clergy purposes, but have also been widely used for restaurant, florist, wedding, or other purposes.

For many reasons, consumers prefer to use oil candles instead of conventional beeswax candles. First, beeswax candles melt when used; therefore, the longer the candle is in use, the shorter it becomes. Aesthetically, it is often undesirable to have candles that vary in length. In addition, beeswax candles have a tendency to drip during use, leading to wax build-up that requires clean-up. Finally beeswax candles are susceptible to the elements; for instance, wind can adversely affect a candle's performance.

Oil candles, while preferred to conventional beeswax candles, also suffer from disadvantages. For instance, oil candles require refueling. In many early model oil candles and some modern candles, users must disassemble the candle and add oil to refuel it. Many consumers find refueling to be cumbersome and inconvenient. In an effort to reduce the time and effort spent refueling oil candles, manufacturers developed oil candles with disposable fuel cells. A disposable fuel cell enables the user to refuel an expended oil candle by simply removing the empty cell and replacing it with a new one. Although, disposable fuel cells have made refueling easier, there are other disadvantages to be considered.

For instance, many conventional oil candles include a disposable fuel cell or bottle and a reusable shell. Manufacturers often make the reusable shell of glass, metal, or a fire-resistant plastic so that the shell does not melt. Moreover, to retain the look of a conventional beeswax candle, manufacturers often produce exterior shells having the same shape and color of ordinary beeswax candles. Unfortunately, reusable shells of this kind are quite costly. Furthermore, in addition to the high cost of the exterior shell, many consumers find it inconvenient to have to continuously remove and replace empty fuel cells.

Conventional oil candles can also be unsafe. Generally, a disposable fuel cell is inserted into the candle and is left unsecured so that it can be easily removed from the exterior shell. While this allows users to have easy access to remove and replace an empty cell, it also provides others with the same opportunity. The removal of the fuel cell from the candle can pose a serious safety hazard. Individuals who want to vandalize a candle or simply remove a fuel cell to save an insignificant amount of money by refilling an empty cell instead of replacing it with a new one are free to do so. Many conventional oil candles do not include safety features to deter the removal of the fuel cell.

Yet another disadvantage associated with ordinary oil candles is the lack of versatility. Since there is no universal size for candle holders, no single oil candle can satisfy the needs of all consumers. For instance, most candle holders are either two inch, one and one-half inch, seven-eighths of an inch, one and one-eighth of an inch, or "all purpose end" sized holders. Therefore, manufacturers must produce many different sized oil candles to satisfy the needs of their consumers. Furthermore, consumers are burdened by having to check the size of their holder to make sure that the candles they order are the correct size.

We have developed an oil candle that is not only superior to conventional beeswax candles, but is also cheaper to manufacture, less expensive to ship, easier to use, safer, and more versatile than existing oil candles.

SUMMARY OF THE INVENTION

Our oil candle is fully disposable. Instead of a reusable glass, metal, or thick fire-resistant plastic exterior shell, we prefer to use a thin, blow-molded resin shell. The use of a thin, resin shell greatly reduces the overall cost of each candle. By blow molding the exterior shell, we can produce a shell that uses less material and is therefore less expensive than the thicker, reusable resin shells commonly used in ordinary oil candles. Furthermore, by making the shell sufficiently inexpensive, it becomes more economical to discard the entire candle than it is to refuel the candle and reuse the exterior shell.

While our candle is less expensive than existing oil candles, it is also more convenient. Instead of having to take the time to disassemble the candle to remove and replace an empty fuel cell, our model allows the user to simply discard the empty candle and replace it will a new fully fueled unit. Moreover, since our candle is designed to be recycled, it poses no risk to the environment.

Until now, manufacturers have not offered consumers a fully disposable oil candle. To produce an oil candle that is fully disposable, a manufacturer must develop a disposable exterior shell that preferably has the appearance of a conventional beeswax candle and is inexpensive enough for single use but also sufficiently resistant to heat to prevent it from melting. The fuel cells used in oil candles include a metal cap to center the wick. When lit, the metal cap becomes heated by the flame of the candle. Conventional oil candles include exterior shells made of metal, glass, or fireresistant plastic to withstand the heat generated by the metal cap. However, our blow-molded exterior shell does not offer the same thermal resistance. Therefore, we have designed our oil candle to include a separator that is preferably molded as part of the fuel cell to maintain a minimum insulating distance between the fuel cell and the outer shell to prevent the outer shell from melting.

In addition to functioning as a thermal insulator, the separator can also function as a safety device. We configure the separator to allow a user to insert the fuel cell into the exterior shell so that the cell and exterior shell become permanently joined. By joining the cell and the exterior shell, the candle becomes a single inseparable unit. Once joined, the fuel cell becomes extremely difficult to remove, thereby effectively minimizing potential safety hazards associated with the removal of the fuel cell.

Finally, we prefer to include a uniquely shaped base on our oil candle to improve the candle's versatility. Because there are so many different sized candle holders, no single candle can satisfy the needs of every consumer. Therefore, we provide two models of our candle with unique bases to alleviate this problem. By tapering the base of each candle and supplying an optional sleeve, we can offer consumers an oil candle that fits almost every standard-sized candle holder on the market. This minimizes the need to custom-manufacture candles to meet consumer needs.

Our oil candle is an improved alternative to conventional beeswax candles and ordinary refillable oil candles. Our candle is more economical, more convenient, more protected, and more versatile than other oil candles on the market.

DETAILED DESCRIPTION

Figure 1A:
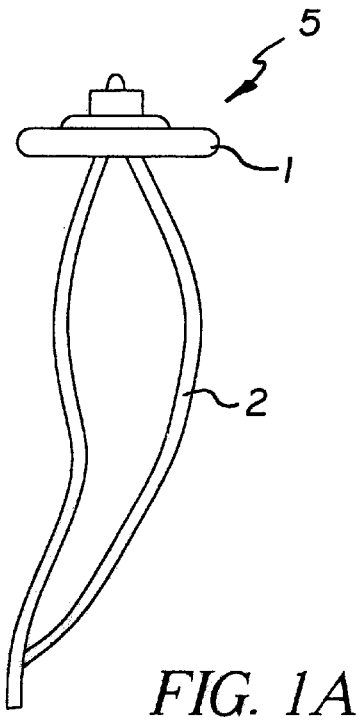
FIG. 1A is a schematic view of a metal wick cap.
Figure 1B:
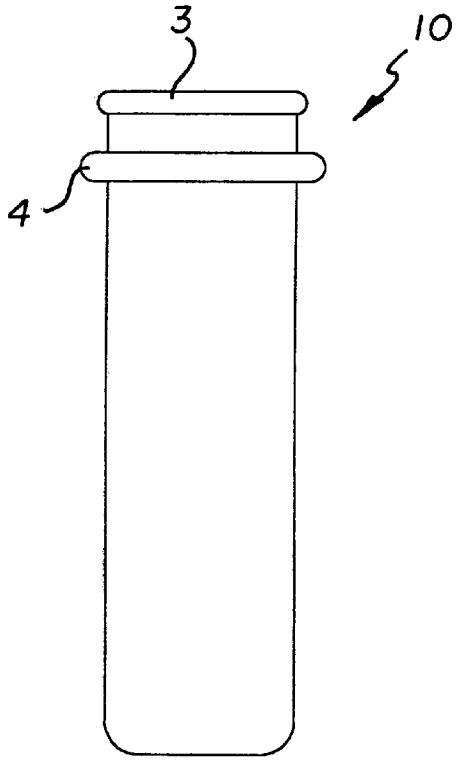
FIG. 1B is a schematic view of a disposable oil fuel cell.
Figure 2:
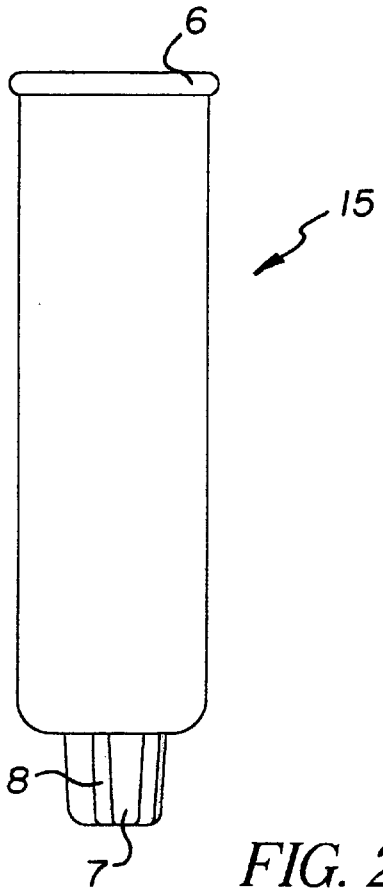
FIG. 2 is a schematic view of a blow-molded disposable shell.
Figure 3:
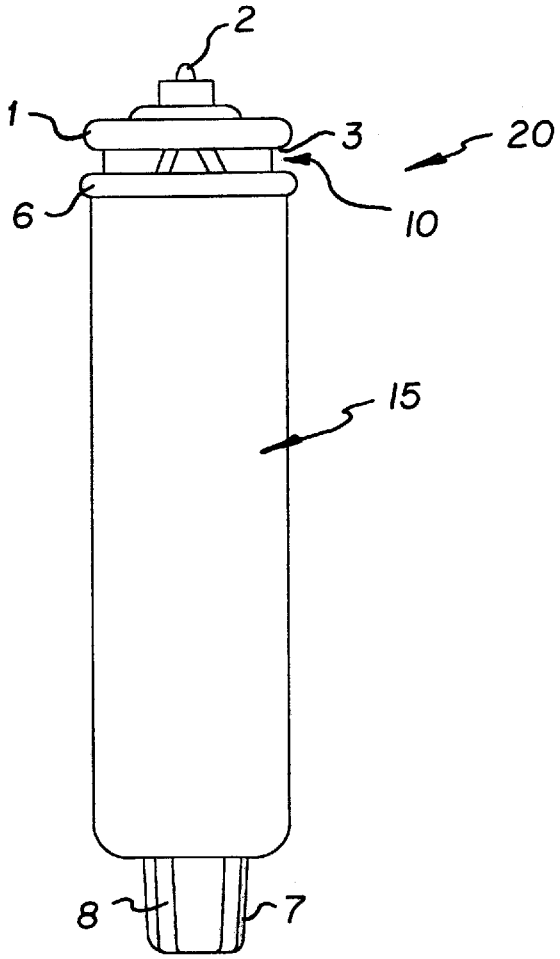
FIG. 3 is a schematic view of the assembled oil bottle.

Our disposable oil candle 20 is comprised of a disposable, blow-molded, resin exterior shell 15 and a disposable oil-filled fuel cell 10.

The disposable blow-molded exterior shell 15 is made of a resin that is preferably lightweight and relatively inexpensive; PVC is one suitable resin. The resin shell 15 is treated with a fire-retardant so that it cannot support a flame. In addition, we prefer to select a resin that is also recyclable so that the disposal of the shell does not pose an environmental risk. Furthermore, we also prefer to configure the shape and adjust the color of the shell 15 so that it resembles a conventional beeswax candle. A radial groove 6 formed along the interior side wall of the shell 15 at the shell's opening accepts an inserted fuel cell and holds it firmly in place. The base 7 of the shell 15 is preferably tapered and configured to include longitudinal ridges 8 so that the shell 15 can be firmly inserted into a holder (not shown).

Figure 6:
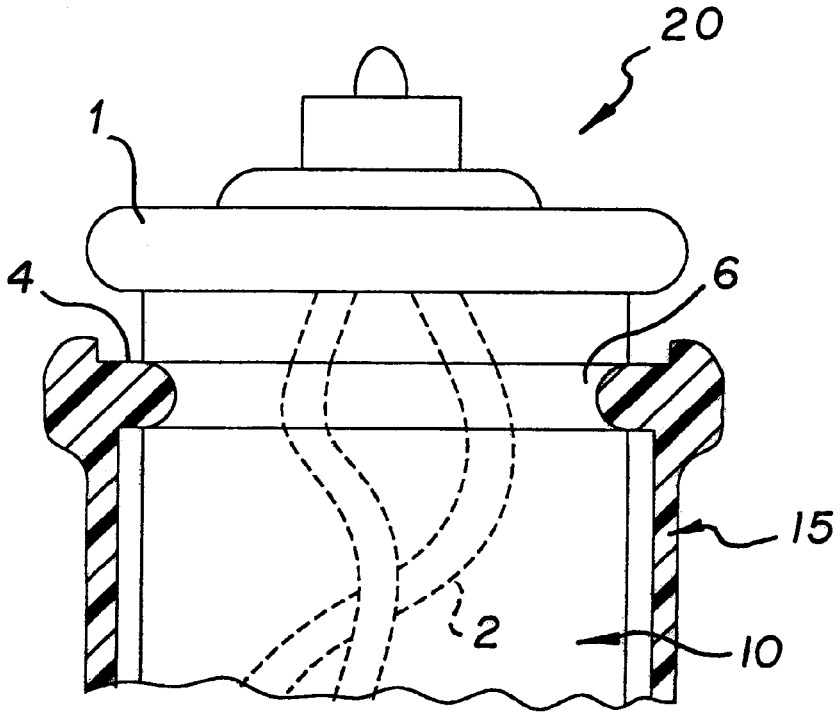
FIG. 6 is a partial cut-away view of an alternate embodiment of the assembled candle.

The disposable fuel cell 10 is also blow molded from a resin. Again, we prefer to use a resin that is relatively lightweight and inexpensive so that the cost of disposal is minimized. Also, the resin selected should be recyclable to minimize the environmental impact of disposal. In addition, because the cell 10 will be exposed to flame, we prefer to treat the resin with a fire-retardant so that the resin will not support a flame. Moreover, because of the heat generated during use, the fuel cell 10 should be configured to include a thick upper rim 3 along the circumference of the open end of the cell 10 to prevent the cell 10 from melting. The ring 3 along the circumference of the open end of the cell 10 is also formed to support a metal wick cap 5. The wick cap 5 includes a radial base ring 1 that is slightly larger in diameter than the support ring 3 at the open end of the cell 10. The base ring 1 fits comfortably over the support ring 3 to close the open end of the cell. The manufacturer can then secure the metal cap 5 to the cell 10 by mechanically wedging the cap 5 onto the supporting ring 3, thereby sealing the cell 10 so that the oil (not shown) within it does not escape during shipping. Finally, we prefer to include a separator as part of the fuel cell to maintain a minimum insulating distance from the metal wick cap 5 to the exterior shell 15. The insulating distance can be a minimum vertical or lateral distance, or it can be both a vertical and horizontal distance. More specifically, we prefer to mold the fuel cell 10 to include a snap ring 4 that can be snapped into the radial groove 6 of the shell 15. (An alternative embodiment where a snap ring 4 is included in shell 15 and a radial groove 6 is included in fuel cell 10 is illustrated in FIG. 6.). By snapping the fuel cell 10 into place, the fuel cell 10 becomes permanently joined with the shell 15. The snap ring 4 holds the fuel cell 10 in place, ensuring that the heated metal cap 5 remains at a minimum insulating distance from the exterior shell 15 to prevent it from melting. Although, we prefer to use a snap ring 4, other alternative separating structures can be used to maintain a minimum distance between the metal cap 5 and the shell 15. However, the snap ring 4 is ideal because it maintains the requisite minimum distance between the cap 5 and the shell 15 while keeping the cap 5 nearly flush with the opening of the shell 15 so that the candle 20 can maintain the appearance of an ordinary beeswax candle. Other separating structures can provide the desired space between the cap 5 and the shell 15, but can alter the candle's appearance, making it appear less like a beeswax candle.

Figure 4:
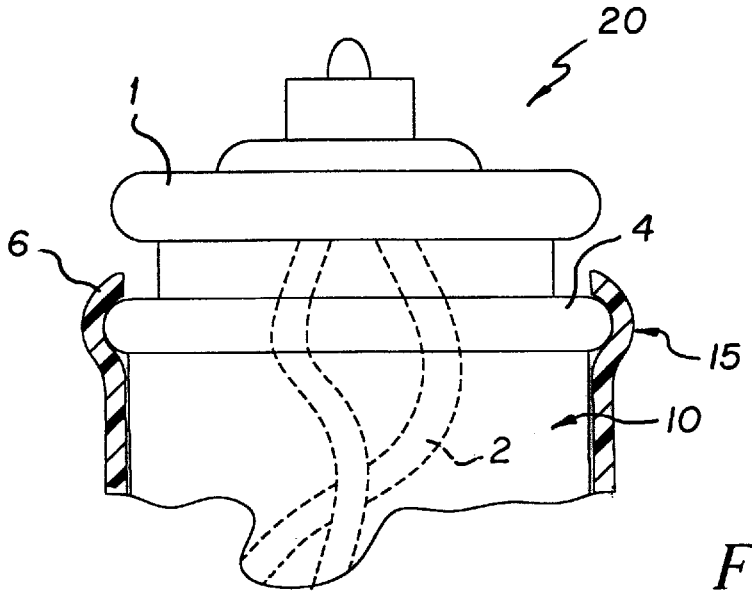
FIG. 4 is a partial cut-away view of the assembled candle.

In addition to functioning as a thermal insulating structure, the snap ring 4 can also function as a safety feature. Because of potential safety hazards associated with the removal of a fuel cell from an oil candle, we prefer to configure the snap ring 4 so that once the fuel cell 10 is inserted into the shell 15, the snap ring 4 enters the interior radial groove 6 and permanently joins the cell 10 and exterior shell 15 (see FIG. 4). By joining the cell 10 and the exterior shell 15 in this manner, it becomes extremely difficult to remove the cell 5 from the exterior shell 15 and effectively minimizes safety hazards that may otherwise exist.

Figure 5A:
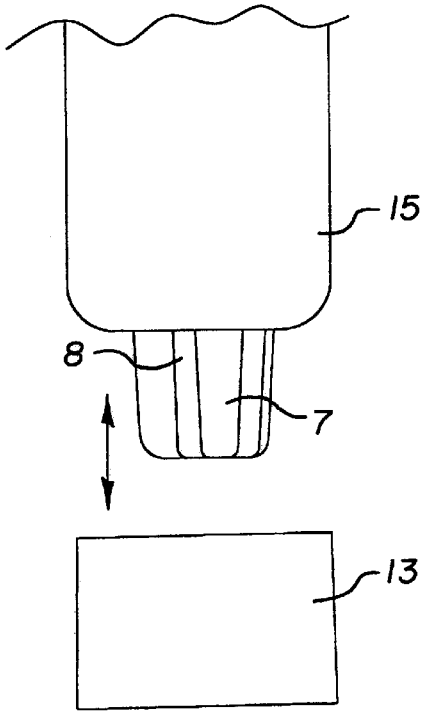
FIG. 5A is a schematic view of one embodiment of a base of the oil candle.
Figure 5B:
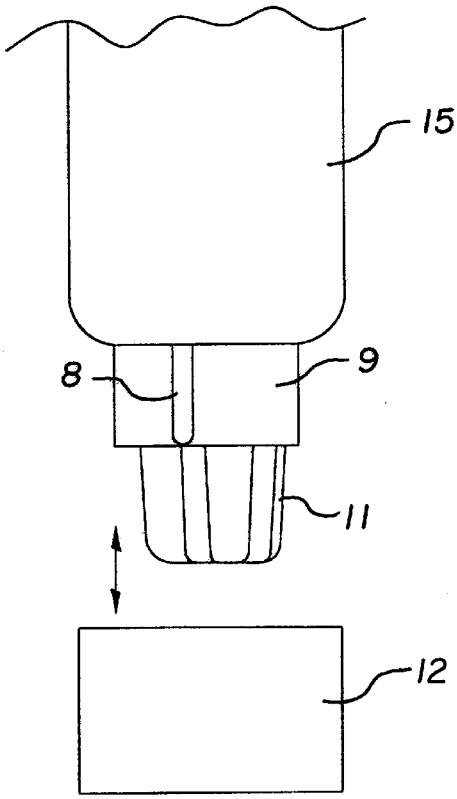
FIG. 5B is a schematic view of a second embodiment of a base of the oil candle.

Finally, our candle 20 also includes a uniquely shaped base to improve versatility. Because there is no single standard-sized candle holder, manufacturers and consumers are required to produce or purchase oil candles that are custom-made to fit a given holder. This requires consumers to take the time to order the correct size candle and requires manufacturers to produce several different sized candles to meet the demands of consumers. We produce at least two models of our candle 20 with bases configured to fit virtually all standard-sized candle holders currently on the market. The first model, as shown in FIG. 5A, includes a tapered base 7. By itself, this base is capable of being used with any seven-eighths inch holder. In addition, we include a sleeve 13 with this model so that the candle can also fit in a one and one-eighths inch holder, which is the standard size holder for the Protestant religions. We also produce a second model with a tiered base, as shown in FIG. 5B. This base includes a first tier 9 that is slightly narrower than the circumference of the shell 15 and a second tier 11 that is narrower than the first tier 9. This unit can be inserted using the first tier 9 in any one and one-half inch holder. Alternatively, a sleeve 12 can be used with this model to allow the candle to fit any two inch candle holder. In addition, this unit can also be inserted into any "all purpose end holder" using the second tier 11 in conjunction with the sleeve 12 to provide added stability. By configuring our candle 20 to include one of these two bases, our candle 20 can be used with 90% or more of the standard-sized candle holders currently in use. This allows manufacturers to be able to fashion a candle that is virtually a one-size-fits-all product.

Our disposable oil candle 20 offers several advantages that are not available to consumers who own conventional oil candles. For instance, unlike existing models, our candle 20 does not require refueling. When the candle 20 runs out of oil, the user can simply remove and discard it and then replace it with a new unit. Consumers will enjoy the added convenience of this feature. Furthermore, since we produce our candle 20 from recyclable resins, its disposal does not pose a threat to the environment.

In addition to being more convenient than existing oil candles, our candle 20 is also more economical. Because we use a thin blow-molded resin shell 15, our shell 15 requires less resin than conventional oil candles that use thicker resin exterior shells. Furthermore, since our shell 15 is kept at a minimum insulating distance from the heated metal cap 5 of the fuel cell 10 to prevent melting, the resin used to form the shell 15 does not have to be as robust as resins used in conventional oil candle shells; therefore, we can use less expensive resins. An even greater economic advantage is realized when comparing our blow-molded resin shell 15 with the more expensive glass or metal exterior shells used in conventional oil candles.

Not only is our disposable candle 20 more economical to manufacture than conventional oil candles, but our candle 20 with its thin, blow-molded disposable shell 15 is also lighter than existing oil candles. The weight of the finished product is significant because of the effect of the product weight on the cost of shipping and distribution. By making the shell 15 thinner and therefore lighter, our candle 20 can be shipped to consumers at a fraction of the cost of conventional oil candles of comparable size.

Our candle 20 is also safer than conventional oil candles. The snap ring 4 permanently joins the fuel cell 10 and exterior shell 15, making it extremely difficult to remove the cell 10. By joining the fuel cell 10 and exterior shell 15, our unit 20 can prevent individuals from removing the cell 10 and can effectively minimize the likelihood of injury or damage.

Finally, our candle 20 is more versatile than conventional oil candles. By configuring our candle 20 to include one of the two above-described bases, our candle 20 can be manufactured and sold to fit 90% or more of the standard-sized candle holders currently in use.

Our candle 20 is an improved alternative to existing oil candles since it is less expensive to manufacture and ship, easier to use, and safer and more versatile than conventional oil candles.

We claim:

1. An oil candle with a disposable fuel cell, the candle comprising:

a. a thin, blow-molded external shell formed from a disposable, recyclable resin;

b. the external shell having an opening at one end and an inner cavity configured so that an assembler can insert the fuel cell through the opening at the end of the external shell and into the shell's inner cavity;

c. the external shell and the fuel cell being configured so that the fuel cell sits within the shell in a position that disposes a wick from the opening in the shell so that the wick remains at a minimum insulating distance from the external shell to prevent the shell from melting when the wick is lit; and d. the fuel cell being joined to the external shell by a snap catch when the cell is inserted and seated within the shell's inner cavity.

2. The oil candle of claim 1, wherein the resin used to form the exterior shell is lightweight and relatively inexpensive.

3. The oil candle of claim 1, wherein the resin used to form the exterior shell is PVC.

4. The oil candle of claim 1, wherein the resin used to form the external shell is treated with a fire-retardant so that the shell cannot support a flame.

5. The oil candle of claim 1, wherein the external shell is formed so that the shape and color of the shell resemble a conventional beeswax candle.

6. The oil candle of claim 1, wherein said snap catch includes a radial groove formed along an interior side wall of the external shell.

7. The oil candle of claim 6, wherein the radial groove is formed along the interior side wall of the external shell proximate the opening at one end of the shell.

8. The oil candle of claim 7, wherein said snap catch includes a snap ring along the circumference of the fuel cell so that when an assembler inserts the cell into the opening of the shell, the snap ring snaps into the radial groove of the shell joining the fuel cell and external shell and ensuring that a top end of the cell remains at a minimum insulating distance from the exterior shell to prevent the shell from melting.

9. The oil candle of claim 8, wherein a top end of the fuel cell is nearly flush with the opening in the shell when the cell's snap ring has been snapped into the external shell's radial groove so that the candle looks like an ordinary beeswax candle.

10. The oil candle of claim 1, including a tapered base that allows the candle to be inserted into a seven-eighths inch diameter candle holder.

11. The oil candle of claim 10, including a sleeve that fits over the tapered base so that the candle can also fit in any one and one-eighths inch holder.

12. The oil candle of claim 1, including a tiered base.

13. The oil candle of claim 12, wherein the tiered base includes a first tier that is slightly narrower than the circumference of the external shell and a second tier that is narrower than the first tier so that a consumer can use the first tier to fit the candle in any one and one-half inch diameter holder and can use the second tier in conjunction with a sleeve to fit the candle in any "all purpose end" sized candle holder.

14. An oil candle with a disposable fuel cell, the candle comprising:

a. a thin, blow-molded external shell formed from a disposable, recyclable resin;

b. the external shell having an opening at one end and an inner cavity configured so that an assembler can insert the fuel cell through the opening at the end of the external shell and into the shell's inner cavity, c. the external shell and fuel cell being configured so that the fuel cell sits within the shell in a position that disposes a wick from the opening in the shell so that the wick remains at a minimum insulating distance from the external shell to prevent the shell from melting when the wick is lit;

d. the fuel cell being joined to the external shell when the cell is inserted and seated within the shell's inner cavity;

e. a tiered base with a first tier that is slightly narrower than the circumference of the external shell and a second tier that is narrower than the first tier so that a consumer can use the first tier to fit the candle in any one and one-half inch diameter holder and can use the second tier in conjunction with a sleeve to fit the candle in any "all purpose end" sized candle holder; and f. a sleeve that fits over both tiers so that the sleeve is flush with the external shell enabling a user to fit the candle in any two inch diameter candle holder.

15. A method of manufacturing an oil candle having a disposable fuel cell, the method comprising the steps of:

a. blow molding a thin, cylindrical external shell from a disposable, recyclable resin;

b. molding the external shell so that there is an opening at one end of the shell and an inner cavity within the shell;

c. configuring the external shell and the fuel cell so that the cell sits within the shell in a position that disposes a wick from the shell's opening so that the wick remains at a minimum insulating distance from the shell to prevent the shell from melting when the wick is lit;

d. inserting the fuel cell into the open end of the external shell and seating the cell within the shell's internal cavity; and e. joining the fuel cell to the external shell by a snap catch so that the fuel cell cannot be easily removed from the external shell.

16. The method of claim 15, including forming a radial groove along an interior side wall of the external shell as part of said snap catch.

17. The method of claim 16, including forming the radial groove along the interior side wall of the internal shell so that the groove is located proximate the opening at one end of the external shell.

18. The method of claim 17, including forming the fuel cell to include a snap ring around the circumference of the cell that is engageable with the radial groove along the interior side wall of the external shell as part of said snap catch.

19. The method of claim 18, including inserting the cell into an opening of the shell so that the snap ring snaps into the radial groove along the interior side wall of the shell so that the cell and shell become joined and so that a top end of the cell remains at a minimum insulating distance from the exterior shell to prevent the shell from melting.

20. The method of claim 19, including snapping the snap ring into the radial groove of the external shell so that the top end of the fuel cell is nearly flush with the opening of the shell so that the candle looks like an ordinary beeswax candle.

21. The method of claim 15, including forming the base of the candle in a tapered configuration so that the candle can be inserted into a seven-eighths inch diameter candle holder.

22. The method of claim 21, including placing a sleeve over the tapered base so that the candle can fit in any one and one-eighths inch diameter candle holder.

23. The method of claim 15, including forming the base of the candle in a tiered configuration.

24. The method of claim 23, including forming the base to have a first tier that is slightly narrower than the circumference of the external shell and a second tier that is narrower than the first tier so that a consumer can use the first tier to fit the candle in any one and one-half inch diameter candle holder and can use the second tier in conjunction with a sleeve to fit the candle into any "all purpose end" sized candle holder.

25. A method of manufacturing an oil candle having a disposable fuel cell, the method comprising the steps of:

a. blow molding a thin, cylindrical external shell from a disposable, recyclable resin;

b. molding the external shell so that there is an opening at one end of the shell and an inner cavity within the shell;

c. configuring the external shell and the fuel cell so that the cell sits within the shell in a position that disposes a wick from the shell's opening so that the wick remains at a minimum insulating distance from the shell to prevent the shell from melting when the wick is lit;

d. joining the fuel cell to the external shell by inserting the cell into the opening end of the external shell and seating the cell within the shell's internal cavity so that the fuel cell cannot be easily removed from the external shell;

e. forming the base to have a tiered configuration with a first tier that is slightly narrower than the circumference of the external shell and a second tier that is narrower than the first tier so that a consumer can use the first tier to fit the candle in any one and one-half inch diameter candle holder and can use the second tier in conjunction with a sleeve to fit the candle into any "all purpose end" sized candle holder; and f. forming a sleeve that can be placed over both tiers so that the sleeve is flush with the external shell enabling a user to fit the candle into any two inch diameter candle holder.

26. An oil candle with a disposable fuel cell, the candle comprising:

a. a thin, cylindrical blow-molded exterior shell made of a disposable, recyclable resin;

b. the external shell having an opening at one end and a central inner cavity;

c. the external shell and fuel cell being configured to include a snap ring and a corresponding radial groove so that when the fuel cell is seated within the external shell's inner cavity, the snap ring engages with the radial groove so that the external shell and the fuel cell are securely joined making the fuel cell not easily removed from the external shell; and d. the fuel cell and external shell also being configured so that when the cell is joined with the shell and is seated within the shell's inner cavity, the cell is positioned so that a wick is disposed from the shell's opening at a minimum insulating distance from the external shell to prevent the shell from melting when the wick is lit.

27. The oil candle of claim 26, wherein the external shell has the shape and color of a conventional beeswax candle.

28. The oil candle of claim 26, wherein the top end of the fuel cell is nearly flush with the opening of the external shell so that the candle looks like a conventional beeswax candle once the fuel cell has been fully inserted into the external shell.

29. The oil candle of claim 26, wherein the fuel cell is configured to include the snap ring around its circumference and the external shell is configured to include the radial groove along an interior side wall so that the external shell and the fuel cell become securely joined when the fuel cell's snap ring engages with the external shell's radial groove.

30. The oil candle of claim 26, wherein the fuel cell is configured to include the radial groove around its circumference and the external shell is configured to include the snap ring along an interior side wall so that the external shell and the fuel cell become securely joined when the external shell's snap ring engages with the fuel cell's radial groove.

31. The oil candle of claim 26, including a universal base that allows the candle to fit several different sized candle holders.

32. The oil candle of claim 31, wherein the universal base is tapered so that the candle can fit any seven-eighths inch diameter candle holder.

33. The oil candle of claim 32, including a sleeve that fits over the tapered base so that the candle fits any one and one-eighths inch diameter candle holder.

34. The oil candle of claim 31, wherein the universal base is tiered.

35. The oil candle of claim 34, wherein the tiered base includes a first tier that is narrower than the circumference of the external shell so that the candle can fit any one and one-half inch candle holder.

36. The oil candle of claim 34, wherein the tiered base includes a first tier that is narrower than the circumference of the external shell and a second tier that is narrower than the first tier so that the second tier can be used in conjunction with a sleeve to fit in any "all purpose end" sized candle holder.

37. The oil candle of claim 34, including a sleeve that fits over the tiered base so that the sleeve is flush with the external shell so that a user can fit the candle in any two inch diameter candle holder.

* * * * *